United States Patent [19]

Bell et al.

[11] 4,319,852

[45] Mar. 16, 1982

[54] BRUSH WITH PNEUMATICALLY DISCHARGED TREATMENT MATERIAL

[76] Inventors: James L. Bell; Dorothy L. Bell, both of 1301 Dogwood Dr., Memphis, Tenn. 38111

[21] Appl. No.: 160,012

[22] Filed: Jun. 16, 1980

[51] Int. Cl.[3] ..... B43M 11/06

[52] U.S. Cl. ..... 401/185; 15/191 A; 15/344; 15/405; 401/200; 401/278; 401/283

[58] Field of Search ..... 15/191 A, 344, 405; 401/184, 185, 188 R, 283, 200, 278

[56] References Cited

U.S. PATENT DOCUMENTS

| | | | |
|---|---|---|---|
| 987,967 | 3/1911 | Danielson | 401/191 A X |
| 1,051,328 | 1/1913 | Harnes et al. | 401/291 |
| 1,757,650 | 5/1930 | Arico | 15/405 X |
| 2,095,727 | 10/1937 | Albertson | 401/185 |
| 2,281,367 | 4/1942 | Moll | 401/291 X |
| 2,547,718 | 4/1951 | Potholm | 15/405 X |
| 2,775,401 | 12/1956 | Storrs | 401/184 X |
| 2,930,060 | 3/1960 | Pearce | 401/184 |

*Primary Examiner*—Chris K. Moore

*Attorney, Agent, or Firm*—Harvey B. Jacobson

[57] ABSTRACT

A material dispensing brush having a substantially rigid holding chamber and a resiliently, deformable bulb attached to the chamber for the purpose of pressurizing the same. The bulb is positioned proximate to the handle of the brush so that an operator may use his thumb to depress the bulb and thus increase the air pressure within the holding chamber so as to effect an ejectment of treatment material outwardly from the chamber through a plurality of dispensing orifices extending through the bristle retaining portion of the brush. The dispensing orifices have a truncated shaped portion proximate to the holding chamber so as to facilitate the delivery of the treatment material into the orifices during a pressurization of the chamber. A pressure relief hole is provided on the deformable bulb so that it may be quickly reinflated by the operator, simply by removing his thumb from the bulb, and the dispensing orifices are substantially aligned in a straight line within the same plane to permit an accurate and controlled dispensing of the treatment material.

3 Claims, 4 Drawing Figures

BRUSH WITH PNEUMATICALLY DISCHARGED TREATMENT MATERIAL

BACKGROUND OF THE INVENTION

1. Field of the Invention

The present invention relates to brushes which incorporate dispensing means for controllably releasing some type of material for use with the brush, and more particularly pertains to a new and improved dispensing brush wherein a manually operated pneumatic means is provided for discharging treatment material.

2. Description of the Prior Art

In the field of dispensing brushes, there has been developed a wide variety of different kinds of dispensing means for controllably releasing some type of material for use with the brush. Frequently, this type of brush is referred to as a "fountain brush" and the basic idea of utilizing dispensing brushes has been applied at least to toothbrushes, shaving brushes, hair brushes, powder brushes, and the like.

Quite often, the prior art dispensing brushes have relied upon a gravity feed as a means of dispensing a treatment material to the brush bristles. For example, in U.S. Pat. No. 2,590,413, issued Mar. 25, 1952, to Jardines, there is disclosed a powder dispenser in combination with a brush wherein a reservoir is provided above the bristles which is adapted to retain a supply of powder or like material which may be controllably dispensed to the bristles. Essentially, a slidable plate is provided within the reservoir, such plate being manually positionable over a plurality of apertures provided between adjacent tufts of bristles, whereby depending upon the positioning of said plate, the apertures may be uncovered to permit a dispensing of the powder from the reservoir outwardly into contact with the bristles. As can be appreciated, this described construction permits a dispensing of powder only when the brush bristles are in a downwardly facing position, since no gravity feed of the powder can be expected if the apertures are facing upwardly. This, of course, is a serious disadvantage associated with gravity feed dispensing brushes, since their function and efficiency are seriously impaired in those situations where it is desirable to utilize the brushes but the bristles are oriented in some manner other than downwardly.

As opposed to gravity feed brushes, there have also been attempts to utilize pressure as a means of dispensing a material in a fountain brush. In U.S. Pat. No. 2,814,060, issued Nov. 16, 1957, to Aschenbach, there is disclosed a shoe dauber which consists essentially of a dispensing brush to which a tube of shoe paste or polish may be attached. In this respect, the tube may be manually collapsed whenever it is desirable to eject some polish into a dispensing chamber and outwardly through apertures positioned between tufts of the brush bristles. This form of pressurized dispensing requires that the material to be dispensed be contained in a collapsible, disposable tube which is attachable to the dispensing chamber of a brush. Once all of the material is dispensed, the collapsed tube may then be removed from the brush and discarded. This form of construction in a fountain brush presents many disadvantages. For example, means must be provided for supporting a dispensing tube, and further, whatever material is desired to be dispensed must first be commercially available in some form of a dispensing tube. In the case of treatment materials, such as liquids, powders, etc., it is highly probable that they will not be available in a collapsible tube, due to packaging and dispensing difficulties. Accordingly, the form of fountain brush disclosed in Aschenbach is really feasible only with respect to pastelike treatment materials.

Still other attempts have been made to overcome these above-discussed prior art disadvantages through the use of dispensing brushes having resilient housings which may be manually compressed to pressurize and thus forcibly expel a treatment material outwardly through apertures between brush bristles. For example, in U.S. Pat. No. 3,597,097, issued Aug. 3, 1971, to Kellis, there is illustrated a dispensing brush having a substantially rigid brush plate and a resilient housing attached to the same. A slide bar is provided in the housing which extends across the brush plate, and by a squeezing of the housing, the slide bar moves to uncover an aperture provided in the brush plate, while at the same time the squeezing of the housing pressurizes a treatment material contained within the housing so as to force an ejectment of the same outwardly through the uncovered aperture. The operation of this device requires the use of the palm of a hand to force the movement of the slide bar, while at the same time all of the fingers must be employed to effectively pressurize the dispensing chamber. Since the entire housing of this brush is of a resilient construction, there occurs problems as to the amount of pressurization which can be obtained therein. Specifically, depending upon the positioning of the brush during a brushing operation, considerable difficulty may be experienced in effectively squeezing the entire resilient housing so as to sufficiently expel a desired amount of treatment material. In that the treatment material is in direct contact with the resilient housing, i.e., the resilient housing serves also as the container for the material, if the housing is too full of material, it may be virtually impossible to efficiently and effectively expel the material from the brush. Similarly, when only a small quantity of treatment material is contained within the housing, a considerable amount of squeezing may be required to effectively pressurize and thus expel the material.

SUMARY OF THE INVENTION

The present invention overcomes the disadvantages and limitations of the prior art by providing for an improved treatment material dispensing brush which utilizes a manually operable, pneumatic pressurizing means to expel the treatment material. In this connection, the present invention envisions the use of a fountain brush having apertures being provided in a brush plate and being in communication with a treatment material holding chamber which is of a generally rigid construction. A manually operated resilient bulb is provided which is in communication with the material holding chamber and which may be squeezed to force air into the chamber so as to pressurize the same and thus expel a material contained therein outwardly through the provided apertures. The pressurizable bulb is so designed as to lie proximate to a handle portion of the brush, whereby an operator may use his thumb to squeeze the bulb to cause a pressurization of the treatment material chamber. A pressure relief hole is provided within the collapsible portion of the pressurizable bulb so that once the operator removes his thumb therefrom, air may be drawn back into the bulb to reinflate the same. The use of the pressure relief hole in the pressurizable bulb prevents the reinflation of the bulb through air being drawn through the apertures positioned in the brush plate which, during those periods when the chamber is filled with a viscous fluid or powder, might create problems, since the material contained within the chamber would tend to clog the apertures and thus prevent a reinflation of the pressurizable bulb.

At such, the constructon of the present invention provides for all of the advantages of similarly employed prior art devices while eliminating the above-discussed disadvantages. In effect, a dispensing brush is provided which has a treatment material holding chamber that is easily pressurizable regardless of the positioning of the brush bristles. Additionally, the brush is operable in response to no more than thumb pressure provided by an operator, and further, any type of treatment material may be used in the brush, including viscous fluids, powders, pastes, and the like.

In a preferred use of the present invention, which is only discussed to illustrate the many possible uses thereof, the dispensing brush could be used for the purpose of defleaing animals, such as cats, dogs, and the like. In this respect, the brush holding chamber could be filled with flea powder, and during a brushing and grooming exercise, flea powder could be injected onto an animal. Such an automatic application of flea powder during a brushing of an animal is most advantageous, since it is a well-known fact that at least some dogs and most cats do not like to be deflead. In efect, through the use of the present invention, only one hand is required to simultaneously groom and deflea an animal, while the animal never becomes aware of such defleaing.

Accordingly, it is an object of the present invention to provide an improved treatment material dispensing brush.

Another object of the present invention is to provide a dispensing brush which will automatically apply a treatment material in one easy step during a routine brushing.

A further object of the present invention is to provide for a material dispensing brush which may effectively dispense powders, liquids, pastes, or the like.

Still another object of the present invention is to provide for a dispensing brush which does not waste treatment material.

A still further object of the present invention is to provide for a dispensing brush which utilizes a readily and easily pressurizable dispensing means.

Yet another object of the present invention is to provide for a dispensing brush which utilizes a rigid treatment holding chamber and which has an externally mounted pressurizing means attached thereto.

An even further object of the present invention is to provide for a dispensing brush which may be used to apply treatment material in desired amounts regardless of the positioning of the brush.

These together with other objects and advantages which will become subsequently apparent reside in the details of construction and operation as more fully hereinafter described and claimed, reference being had to the accompanying drawings forming a part hereof, wherein like numerals refer to like parts throughout.

DESCRIPTION OF THE PREFERRED EMBODIMENT

Figure 1:
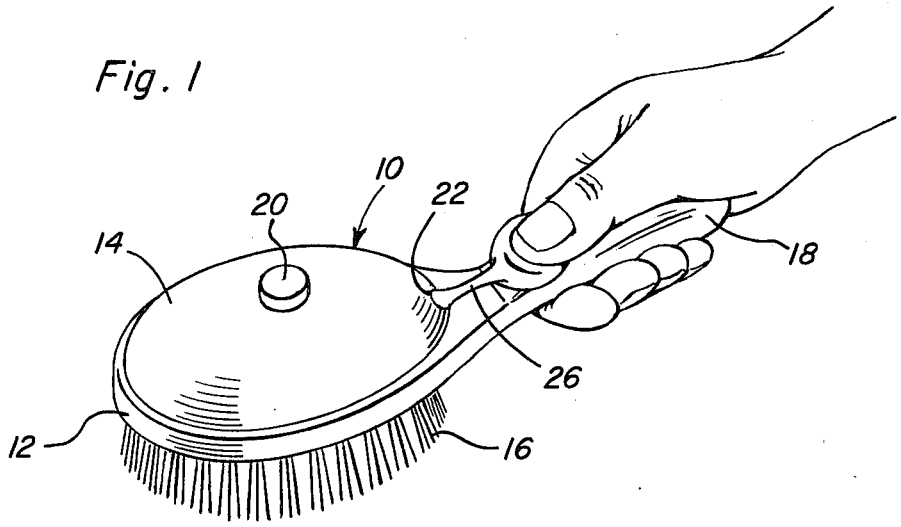
FIG. 1 is a perspective view illustrating the dispensing brush of the present invention.

FIG. 1, which illustrates the preferred embodiment of the present invention, shows a perspective view which essentially comprises a dispensing or fountain brush generally denoted by the reference numeral 10 and having a bristle-retaining brush plate 12 with a rigid shell or holding chamber 14 sealably attached thereto. A plurality of bristles 16 are shown emerging from one side of the brush plate 12, and a brush handle 18 is shown integrally attached to the brush plate. Additionally, there is shown a filler plug or stopper 20 positioned on an uppermost portion of the holding chamber 14, such stopper being removable to permit the filling of the holding chamber with a treatment material. Further, an orifice 22 is shown positioned at one end of the holding chamber 14 to which is attached a pressurizing rubber bulb or bellows 24.

Figure 2:
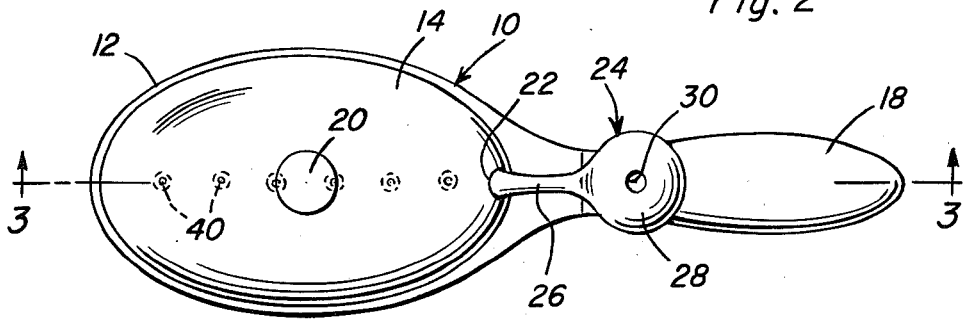
FIG. 2 is a top plan view of the present invention.

Referring now to FIG. 2 of the drawings, which illustrate a top plan view of the present invention, it can be seen that the rubber bulb 24 includes an extended narrow neck portion 26, having one end thereof extending outwardly from and attached to the orifice 22, and an inflated bulbous portion 28 integrally attached to the other end of the extended narrow neck portion. Additionally, a pressure relief hole 30 is provided in an uppermost location of the bulbous portion 28, so as to permit easy access thereto by an operator's thumb.

Figure 3:
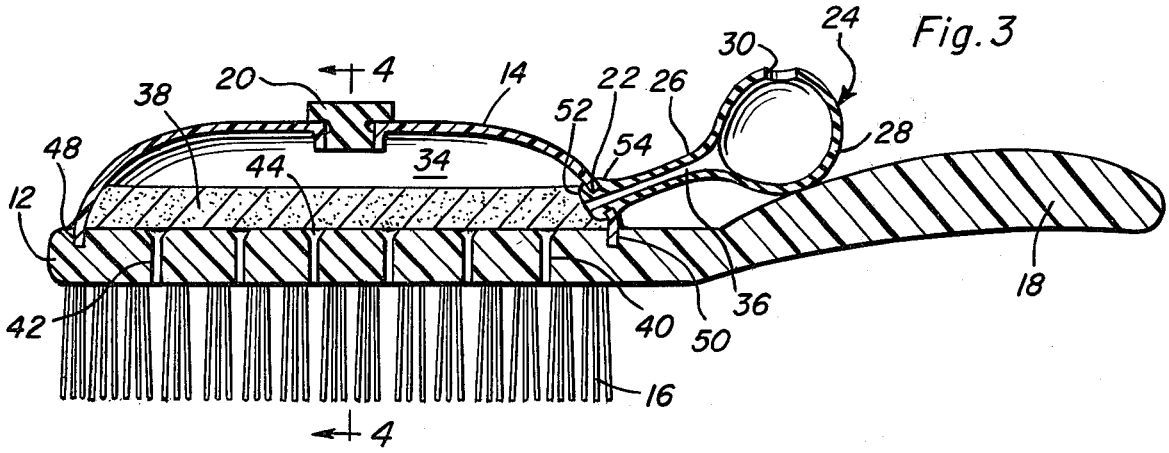
FIG. 3 illustrates a longitudinal sectional view taken substantially on the plane of line 3—3 of FIG. 2 looking in the direction of the arrows.

As is more clearly shown in FIG. 3, which is a longitudinal sectional view through the brush taken along the plane 3—3 of FIG. 2, it can be seen that the pressure relief hole 30 is in direct communication with an interior cavity 32 of the bulbous portion 28, while the cavity itself is in communication with the interior 34 of the holding chamber 14 by means of a longitudinally-extending channel 36 contained within the extended narrow neck portion 26 of the pressurizing bulb 24.

Contained within the holding chamber interior 34 is a treatment material 38 which is dispensable through a plurality of material dispensing orifices 40. The orifices 40 are positioned between individual tufts of the bristles 16, and permit an ejection of the treatment material 38 between and onto the brush bristles. In this respect, each of the individual orifices 40 are provided with a narrow, longitudinal cylindrically-shaped bore section 42 and a truncated or cup-shaped section 44 concentrically aligned and in communication therewith. Of course, the shape of the orifices 40 may be varied to accommodate the dispensing of different kinds of treatment materials.

To effect an airtight seal when needed between the holding chamber interior 34 and the outside atmosphere, the stopper 20 is designed for a tight, frictional engagement with a treatment material filler hole 46 which is provided in the topmost portion of the holding chamber 14. Further, the brush plate 12 is provided with an elliptically-shaped groove 48 into which an edge portion 50 of the holding chamber 14 may be positioned so as to be sealingly attached thereto in a known and conventional manner. Additionally, an airtight connection is maintained between the orifice 22 and the extended narrow neck portion 26 of the pressurizing bulb 24 through the use of first and second lip means 52, 54, respectively. In this connection, the first lip means 52 is designed for a frictional engagement with an interior portion of the holding chamber 14, while the second lip means 54 provides for a sealing, frictional engagement with an outer portion of the holding chamber.

Figure 4:
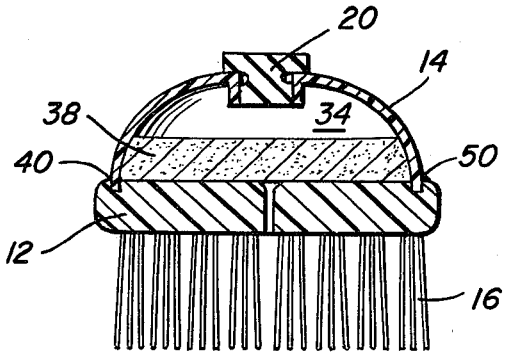
FIG. 4 is a transverse sectional view taken substantially on the plane of line 4—4 of FIG. 3 and looking in the direction of the arrows.

As can be appreciated with reference to FIG. 4, which is a transverse sectional view taken substantially on the plane of line 4—4 of FIG. 3, as well as reference again to FIG. 2, the plurality of orificies 40 are positioned in a straight line so that their longitudinal axes lie substantially within the same plane. As such, any treatment material 38 which is dispensed through the orifices 40 is essentially contained within a central, aligned location of the total area covered by the brush bristles 16. In effect then, a controlled dispensing of the treatment material 38 may be realized with little or no wastage, since before the material can be dissipated outwardly from the sides of the brush, it must pass through a very thick and congested collection of brush bristles. In other words, if the dispensing orifices 40 were located near an edge portion of the bristle-retaining brush plate 12, any dispensing of treatment material 38 into the bristles 16 would result in a substantial portion of that material being ejected outwardly and sideways from the bristles, thus permitting a wastage thereof. Further, the in-line positioning of the orifices 40 provides the operator with the advantage of being able to carefully direct the flow of treatment material 38 to a desired location.

In operation, the filler plug or stopper 20 is removed from the treatment material filler hole 46 and the holding chamber interior 34 is partially or completely filled with a powder, liquid, paste, or other desired treatment material 38. The stopper 20 is then reinserted into the filler hole 46, and the dispensing brush 10 is now ready for use. To effect a desired dispensing of the treatment material 38, the operator need only grasp the handle 18 while positioning his thumb over the pressurizing rubber bulb 24 and the pressure relief hole 30 contained thereon. A brushing operation may then be commenced and when it is desired to dispense some of the treatment material 38, the operator need only forcibly collapse the rubber bulb 24 with his thumb, and since the pressure relief hole 30 is closed, the air trapped in the bulb interior cavity 32 is forced down the longitudinally-extending channel 36 and into the holding chamber interior 34, pressurizing the same.

In response to the pressure created in the holding chamber interior 34, the treatment material 38 is forced firstly down into the truncated or cup-shaped bores 44, such shape being provided to facilitate an easy flow of the treatment material therein, and then subsequently through the narrow, longitudinal cylindrically-shaped bore sections 42. As is readily apparent from reference to the drawings, the treatment material 38 is then ejected outwardly into contact with the brush bristles 16 and therefrom into contact with the object being brushed.

To effect another ejectment of treatment material 38, the operator need only remove his thumb from the pressurizing bulb 24, so as to uncover the pressure relief hole 30, thereby allowing air to enter through the hole into the bulb interior cavity 32, thus permitting a reinflation of the pressurizing bulb. As such, the dispensing brush 10 is now primed for another dispensing operation.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as new is follows:

1. A material dispensing brush including a handle and a bristle-retaining plate associated therewith, said bristle-retaining plate having a plurality of bristles fixedly positioned thereon, said dispensing brush further including:

a rigid shell having its edges fixedly attached to the bristle-retaining plate and having an interior defining a material holding chamber means for holding treatment material to be dispensed;

a deformable hollow resilient member separately communicating with the holding chamber means through an elongated tube means connecting to a wall of the rigid shell and to a wall of the holding chamber means, the deformable resilient member having a pressure relief hole in a surface of the deformable resilient member and defining therewith a pressure relief means and being positioned substantially adjacent the handle whereby placing one's thumb over the pressure relief hole closes the hole and whereby applying continuing pressure by the thumb onto the handle and compressing the resilient member directs air from the deformable resilient member through the tube means into the holding chamber means to effect an increase in air pressure in the holding chamber means;

a plurality of orifices constructed in the bristle-retaining plate and having their longitudinal axes lying substantially in the same plane to provide a controlled dispensing of the treatment material with little or no wastage and providing the advantage of being able to carefully direct the flow of treatment material to a desired location, the orifices releasing the increase in air pressure in the holding chamber means and serving to direct a flow of material from said holding chamber means onto a work surface engaged by bristles of the bristle-retaining plate, the orifices including a narrow, longitudinal cylindrically-shaped bore section adjacent the work surface thereof and further including a concentrically aligned truncated bore section communicating therewith and with the holding chamber means, a first end of the truncated bore section being of substantially the same diameter as the cylindrically-shaped bore section and a second end of the truncated bore section being of a greater diameter than said cylindrically-shaped bore section; and a removable filler plug inserted in an opening in an uppermost portion of the holding chamber means and being removable to permit the filling of the holding chamber means with the treatment material.

2. The invention of claim 1 wherein the elongated tube means is connected to the wall of the rigid shell by use of first and second lip means, the first lip means providing frictional engagement with an interior portion of the holding chamber means while the second lip means provides for a sealing, frictional engagement with an outer portion of the holding chamber means.

3. The invention of claim 1 wherein the elongated tube means includes means positioning the deformable resilient member in contact relation with the handle so that closing the pressure relief hole with the thumb and further application of the thumb forcibly collapses the deformable resilient member and air trapped in the cavity of the deformable resilient member is forced down the elongated tube means into the holding chamber means for maximizing the transfer of pressurized air from the cavity to the holding chamber means.

* * * * *